US005967327A

United States Patent [19]

Jones

[11] Patent Number: 5,967,327

[45] Date of Patent: Oct. 19, 1999

[54] ARTICLE SUSPENSION PACKAGE, SYSTEM AND METHOD

[75] Inventor: William Charles Jones, East Sandwich, Mass.

[73] Assignee: Emerging Technologies Trust, Osterville, Mass.

[21] Appl. No.: 09/165,764

[22] Filed: Oct. 2, 1998

[51] Int. Cl.[6] ..... B65D 81/07

[52] U.S. Cl. ..... 206/583; 206/466

[58] Field of Search ..... 206/466, 478, 206/486, 583, 588

[56] References Cited

U.S. PATENT DOCUMENTS 5,226,542 7/1993 Boecker et al. ..... 206/583
5,323,896 6/1994 Jones .
5,388,701 2/1995 Ridgeway ..... 206/583
5,407,076 4/1995 Sabet ..... 206/486
5,669,506 9/1997 Lofgren et al. ..... 206/583
5,676,245 10/1997 Jones .
5,678,695 10/1997 Ridgeway et al. ..... 206/583
5,694,744 12/1997 Jones .
5,722,541 3/1998 Lofgren et al. ..... 206/583
5,893,462 4/1999 Ridgeway ..... 206/583

*Primary Examiner*—Jim Foster
*Attorney, Agent, or Firm*—Richard P. Crowley

[57] ABSTRACT

A package, system and method for the protective covering and immobilization of an article for packaging. The package comprises a base with tension-biased flaps to support the article within the base and side panels from the base to extend above the packaged article. The package includes end-secured, overlapped film layers with an overlap area and an overlap slot to permit the article to be inserted in or removed from the suspension position in the base.

17 Claims, 10 Drawing Sheets

ARTICLE SUSPENSION PACKAGE, SYSTEM AND METHOD

BACKGROUND OF THE INVENTION

There are a wide variety of suspension and tension-type packaging kits, systems and methods for the immobilization of articles and packages used for shipment in an outside container; and which packaging kits are designed to provide for protection of the article during shipping and handling, and particularly where such articles may be fragile in nature, subject to static, or conductive damage. More particularly, packaging kits, systems and methods for mobilizing, suspending and protecting electronic-type articles.

Some forms of packaging kits, systems and methods where an article is immobilized in a film tube on a base, are as set forth, for example, in U.S. Pat. Nos. 5,323,896, issued Jun. 28, 1994, and 5,676,245, issued Oct. 14, 1997, and 5,694,744, issued Dec. 9, 1997, both incorporated by reference, wherein a thin film, typically transparent film material is tension-biased about a stiff sheet of corrugated cardboard material to immobilize the article on the stiff sheet material. The packaging of articles may also be accomplished by suspension-type packages wherein an article is suspended within a frame, more particularly, as illustrated in U.S. Pat. Nos. 5,769,235, issued Jun. 23, 1998; 5,722,541, issued Mar. 3, 1998; 5,669,506, issued Sep. 23, 1997; and 5,579,917, issued Dec. 3, 1996.

It is therefore desirable to provide for a new, effective, and improved, suspension film-type package, system and method for the immobilization and protection of articles; particularly fragile and sensitive articles, wherein the article may be rapidly and easily inserted within the package and easily removed therefrom, as required, and yet be fully protected during shipment and handling.

SUMMARY OF THE INVENTION

The invention relates to a suspension, film-type article packaging system and method, and the packaging of articles; particularly fragile, odd-shaped articles; which articles may be easily inserted and removed from the package, and to a system and method of packaging and protecting such articles for shipment or display.

The invention comprises a suspension, film-type article package, system and method wherein a package is designed to hold an immobilized article; particularly a fragile or odd-shaped article and a wide variety of articles, either alone or together within a package, in which the package is designed to be inserted into an outer shipping container for transport and handling.

The invention also includes a package, system and method wherein the film material is gathered and secured at the outer sides by notches or dovetail openings cut into or formed in opposing flaps of the base. In this embodiment, the longitudinal opposing flaps, with the film material receptors, hold the gathered sides of the film material in position by frictional insertion of the film material by a user in the receptor, usually at each longitudinal package end at each side.

The receptor may comprise separate notches for each gathered side of the film method, or as illustrated, have a single transverse dovetail or trapezoidal opening across each end flap, with sharp inward angled corners to receive and hold the gathered film material. Other means and techniques to hold and secure the sides of the film material to the end flaps may be used, such as: permanent or removable clips; adhesives; pins; tabs; tape; and the like.

In this embodiment, the opposing end flaps extend upwardly, while the side flaps extend downwardly to provide support for the packaged article in the center of the base. The article to be packaged is covered by the slit-overlap film layers, or more typically, within a film tube with the top surface of the film tube overlapped and slit, as desired, to cover and seal the article in the film tube on the base, yet permit ease of entry into, or removal from, the tube through the overlapped slit.

This base embodiment of the package narrows the width of the film material at each end, and on each side, over the packaged article relative to the article width. The gathered, secured, corner film material and transverse, upward end flaps restrict the movement or travel of the packaged article during handling, or particularly on tipping of the package on the longitudinal axis.

An article package kit, system and method which employs a film tube with notches to hold the film tube on the base portion are described in U.S. Pat. No. 5,676,245, issued Oct. 14, 1997, is hereby incorporated by reference.

The package system of the invention involves a base formed of a stiff sheet material having a plurality of selected fold lines, such as a cardboard-type material, which may be folded into a selected base form; and wherein the base is adapted to receive the article to be packaged and to hold the article in a covered film, suspended-article position within the base.

The base includes two opposing, upright side walls and two interconnecting, opposing, upright end walls to define a base of sufficient dimensions to receive and package the designated article. Further, the base has a top and bottom surface. Typically, the base is formed of a relatively inexpensive, sheet-type material which is perforated, cut, and folded to form a base; generally, a rectangular-type base; and with the base character having a plurality of at least one pair of opposing, internal flaps extending from opposing walls; and more particularly having two pairs of opposing, internal flaps extending from each of the opposing walls and toward the center of the base with the flaps formed generally by 45° longitudinal and transverse cuts made in the sheet material. The flaps so formed are tension-biased by virtue of the relative stiffness of the sheet material and biased in a planar position, so that an article to be packaged is placed on the internal surface of the flaps within the base, and is placed in a suspended, packaged position surrounded by the opposing side walls and held by the tension-biased flaps.

In the article suspension position, the base is characterized by a somewhat open internal space extended between the internal side flaps within the base. The base includes a plurality of at least one pair of opposing, either transverse or longitudinally extending side panels, extending outwardly from the opposing walls and subject to be folded into position; the external panels folded to extend a selected distance above, below, or both, the plane of the base to provide additional protection above the top surface of the packaged article, or to suspend the bottom surface of the base from the container in which it is to be placed, or to both suspend the bottom surface and also to protect the top surface of the package article.

The base may include cutout sections on either part of the side panels, with smaller flaps therein and perforations in the external opposing side walls, so that the small flaps may be tucked therein in order to retain the side panels and a selected upright position. Typically, the side panels extend in the suspended package position perpendicular to the plane of the base and above the top, or bottom, or both surfaces on the base.

The base includes a film material; typically, an elastomeric film material; for example, but not limited to olefinic-type films like: polyethylene, urethane, vinyl or other films which are generally transparent, so the article may be seen. The film material is placed only over the top surface of the base to form a snug, generally tensioned relationship, to form an overall covering over the top surface of the base; or may be a film tube, so that the article is secured within the top and bottom layer of the film tube, while the film tube ends are secured to the base at each film tube end.

The film material is designed to add slightly overlapping, opposing surfaces to form a transverse or longitudinal slit therein, generally of sufficient length to permit the insertion or removal of the article into the suspended position on the base and generally extending substantially the transverse or longitudinal length of the base.

This overlapping film material arrangement; for example, one half (½) to up to three (3) inches overlapping, permits the easy insertion and removal of the article to be packaged by the user and through the insertion of the article through the overlapping slit; while the nature of the thin film elastomeric material permits slight extension of the film material, so that after positioning of the article in the suspended position on the flaps, the thin film material forms a snug covering relationship over the suspended article.

The thin film material is such in nature that the user may merely extend his hand through the overlapping slit in order to grasp and retrieve the article from the suspended position, as desired. The nature of packaging system and method enables the package to be recycled over and over again, thus providing an environmentally sound package.

Typically, the film material may extend and be easily secured across the top surface, or at least one surface of the base; by securing, such as adhesively, by heat-bonding opposing ends of the material to the base and generally to the bottom surface of the base creating a heat-sealing or heat-bonding relationship, so that the thin film overlapping material formed of two extending films, or three or more, if desired, with two slits, if desired; so that the thin film material is snug and taut enough about the article being inserted to permit the article to be removed without tearing or unnecessarily stretching or destroying the film during the insertion or removal steps.

Thus, the package does not require the tension-bias of the thin film material as a clinging-type film above the external surface of the article to be packaged as in wholly tension-bias packaging.

The package system includes a package including a base with the thin film material, the insertion of the packaged article in the suspension film-covered position, and includes the placing of the package in the base of an outer container for shipment or transportation; but typically, the base material, for example, rectangular in nature and adapted to fit snugly within the interior walls of the shipping container, yet with the external side panels folded perpendicularly, provides for, if necessary, slight suspension of the bottom surface of the base, from the bottom surface of the shipping container and the side panels, to extend slightly above the top surface of the packaged article to provide additional protection within the shipping container. The side panels may extend upwardly and downwardly and generally perpendicular on opposing sides; as desired, for example, from one half (½) to three (3) inches.

The package system and method of the invention, thus provides for an environmentally sound, inexpensive, rapid, effective, suspension film-covered article package at a low cost and yet provides full protection to the article to be packaged.

The base portion of the package may be easily formed from a stiff, flat sheet material by cut lines and perforations to form fold lines, and the film material secured easily and positioned in an overlapping film relationship over the two, three, or more films over the top surface of the base. Rather than securing the end portions of the thin film material by heat-sealing or adhesives, it is recognized that the film material may be slipped over the base portion, or the film portion may be removably secured, such as by notches, in position over the base material, so as to enable the film material to be separately removed, so that the film material and the base material may be separately removed, reused and recycled.

The invention will be described for the purpose of illustration only in connection with certain illustrated embodiments; however, it is recognized that various modifications, changes, additions and improvements may be made to the illustrated embodiments without departing from the spirit and scope of the invention.

DESCRIPTION OF THE EMBODIMENTS

Figure 1:
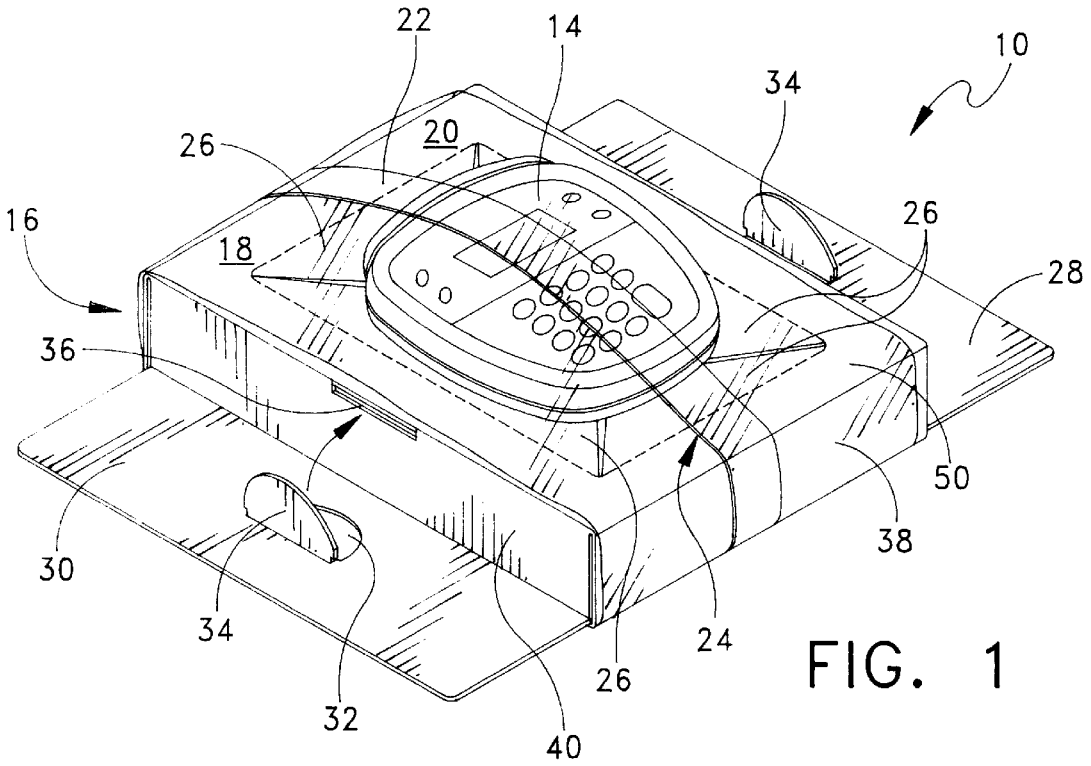
FIG. 1 is a perspective view from above of a suspension support package of the invention enclosing and packaging an electronic device as an article.
Figure 2:
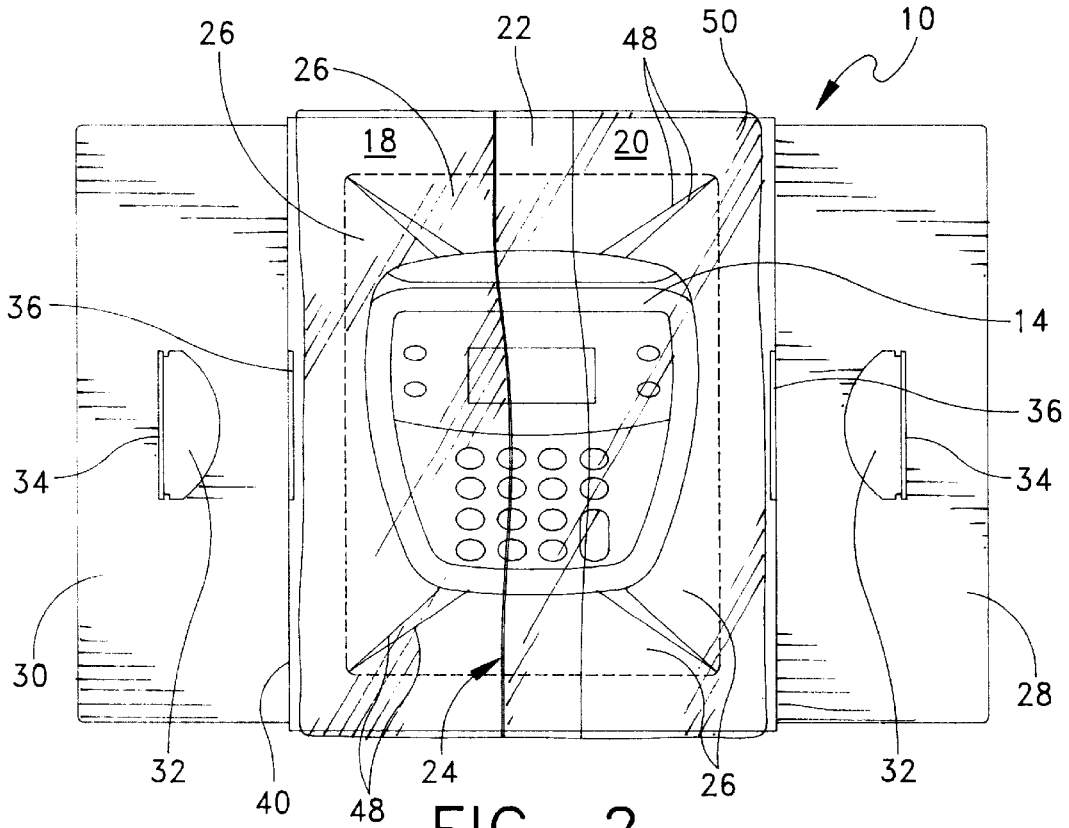
FIG. 2 is a top plan view of the package of FIG. 1.
Figure 3:
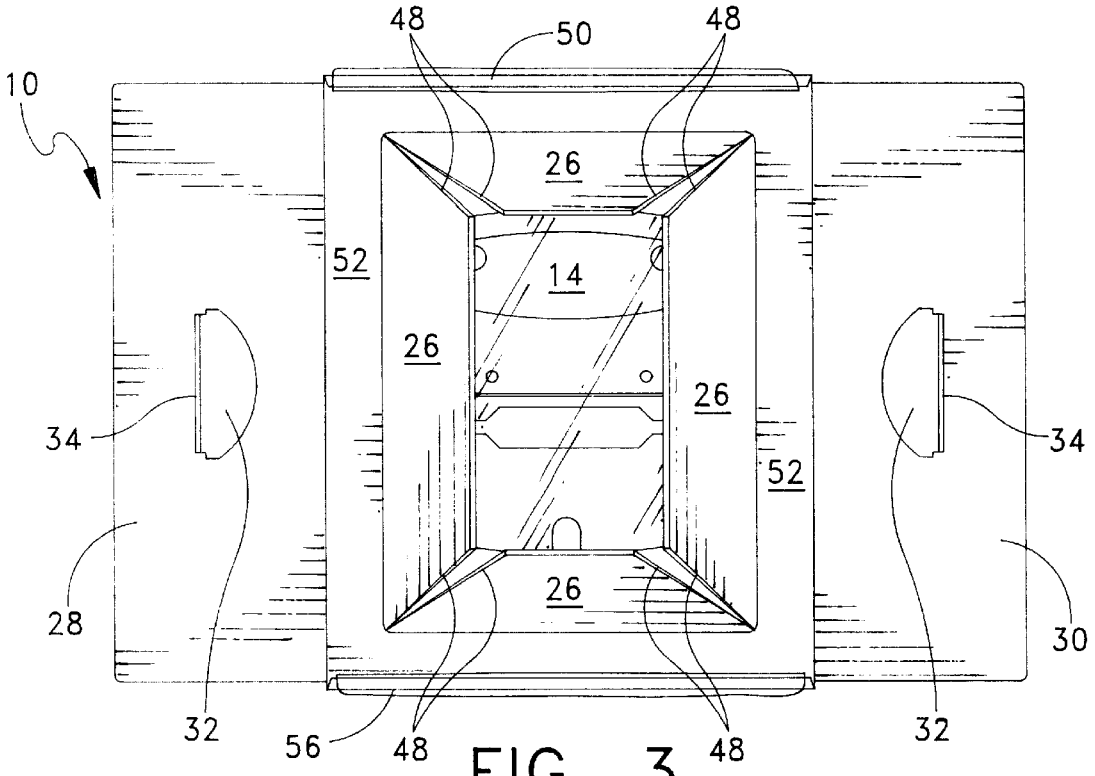
FIG. 3 is a bottom plan view of the package of FIG. 1.
Figure 4:
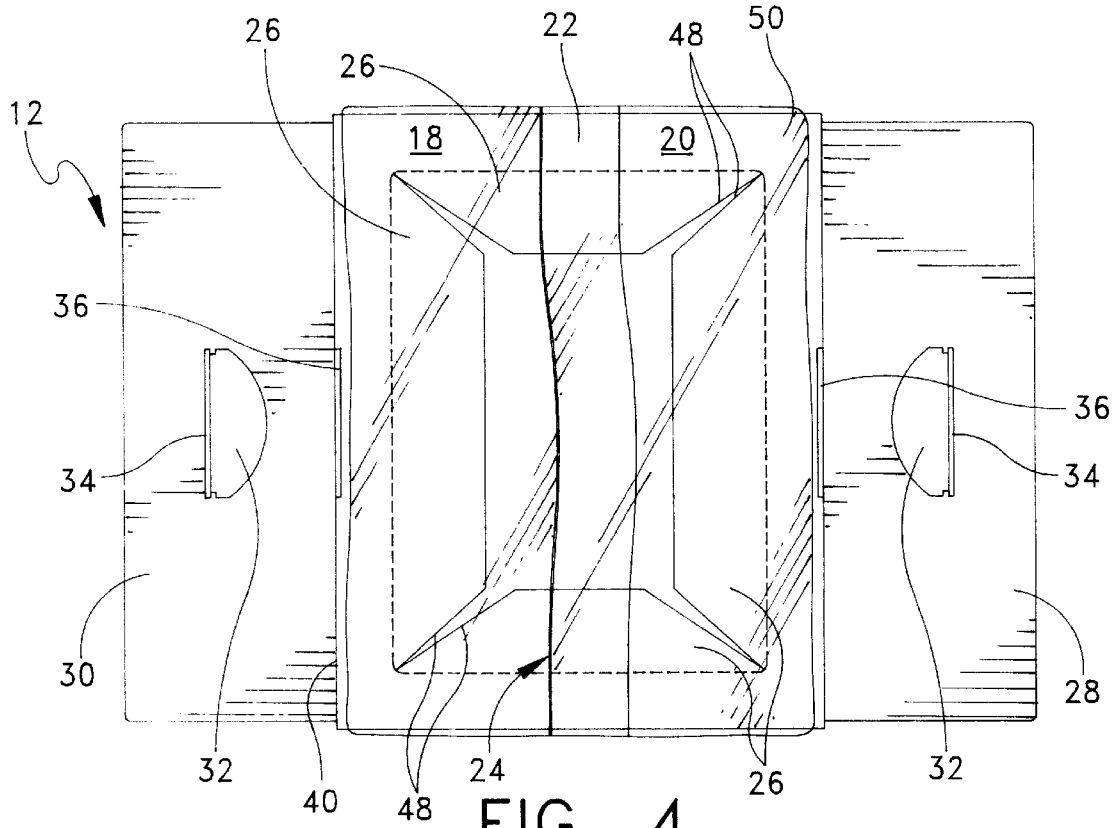
FIG. 4 is a top plan view of the package of FIG. 1 without the electronic device.
Figure 5:
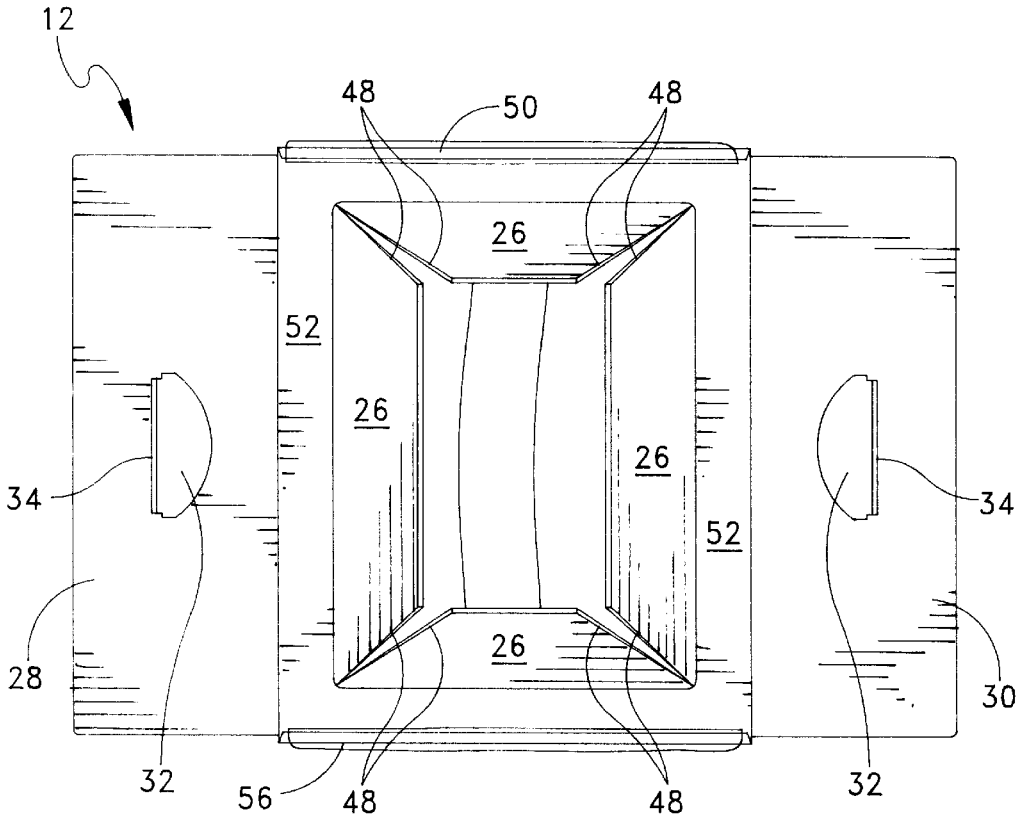
FIG. 5 is a bottom plan view of the package of FIG. 1 without the electronic device.
Figure 6:
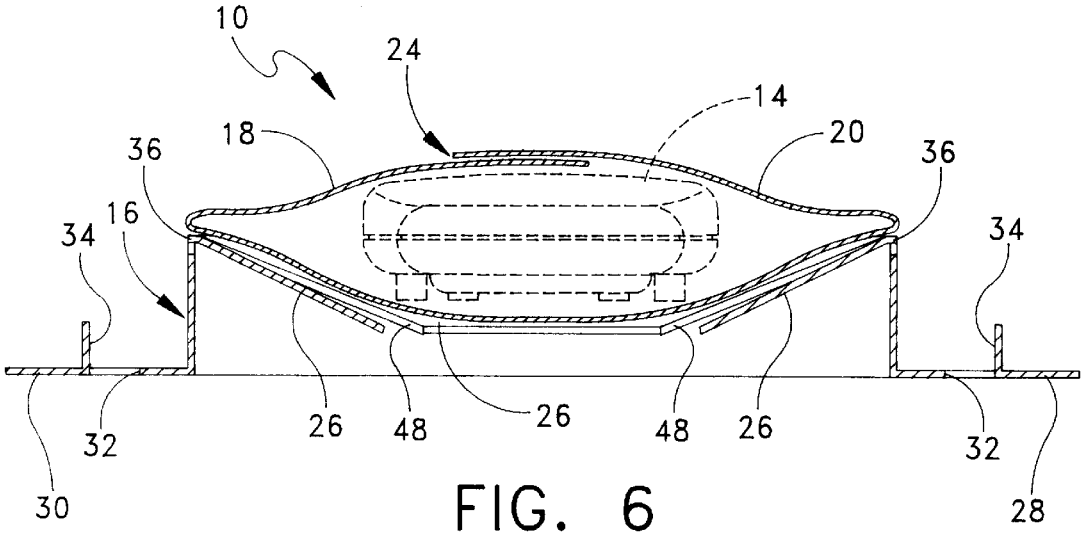
FIG. 6 is a sectional view along lines 6—6 of the package of FIG. 1.
Figure 7:
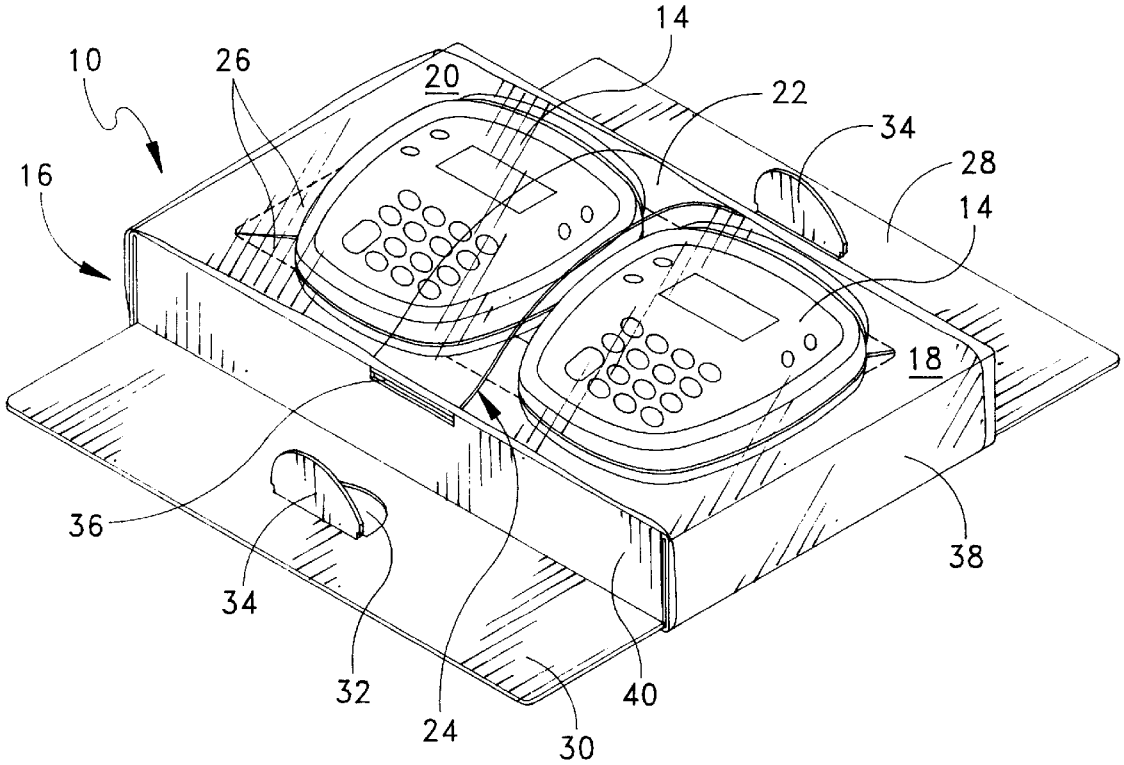
FIG. 7 is a perspective view from above of another support package with a pair of electronic devices suspended and packaged.

In FIGS. 1–6, there is shown a package system of the invention 10 with a packaged electronic device 14 secured in the package and the package without device 12. The package includes a base 16, alone for example (see FIG. 10) and FIG. 11, without a film covering material and formed of a stiff material, such as cardboard 44 (see FIG. 10), having a plurality of perforated fold lines 46 and cutout lines 48. The sheet material 44 is designed to be folded together to form the three dimensional base 16, as illustrated. The package 12, with the base 16, includes in this illustration, a first 18 and a second 20 thin, elastomeric, stretchable; and optionally but preferably, transparent film layers, for example of a polymer-type material, which film layers overlap to form a designed overlap area 22; for example, one half (½) to three (3) inches in a typical package, which includes a longitudinal slit 24 defining the intersection of the overlap between the top and bottom film layers 18 and 20, and the slit 24 may be longitudinal and generally extend the length of the base 16, or if desired, may be a transverse slit as shown in FIG. 7, or even a diagonal-type slit.

The thin elastomeric film layers 18 and 20 are secured at each end, such as by adhesive or heat-seal, to the bottom surface 52 of the base 16, so that the film layers directly overlap at their overlapping edges and extend over the top plane surface of the base 16 to form a slightly taut, slightly stretchable, transparent film cover over the electronic device 14 or other article which is to be package in the package system 10.

Typically, each of the film layers is transparent, although not necessarily, and generally range from 1 to 5 mils and typically is slightly stretchable, so that in use the electronic device 14 or other article to be packaged, may be inserted by a user through the slit 24 and placed within the base 16 (for example, see FIG. 9) or the package or article 14 removed from the package, so the package may be reused; that is, the article is removed without damage to the film. The film layers 18 and 20 may comprise a thin polymeric layer, more typically of an olefin, such as a polyethylene, like low density polyethylene or a metallocene polymer, vinyl, urethane or other selected polymeric film.

The packaging system 10 thus comprises a simple arrangement of a three dimensional base 16 containing overlapping secured films 18 and 20 with a slit to permit entry and insertion and removal of the packaged article.

The base 16 comprises a plurality of opposing, cutout, tension-biased support or suspension flaps 26 generally uniformly cut out of the base sheet material 16 along cut lines at a 45° angle 48 to form the flaps 26. The flaps 26 adapted to extend downwardly slightly, while having a sufficient tension from the sheet material to support and suspend the packaged article 14 on the interior surface of the flaps. The flaps in the suspended or cut position forming an open area 42 in the bottom of the base 16.

The tension-biased flaps extend a slight distance, such as a width of 1 to 2 inches, formed along perforated lines 48 in the sheet material 44. The flaps 26 have sufficient width, tension, and length in order to support the desired article 14 to be packaged.

The base includes first and second extended side panels 28 and 30 opposing each other from base 16; and each of the side panels having an arcuate cutout 32 in the side panels 28 and 30 with an arcuate cutout flap 34 in the side panels. The base 16 includes, in sheet material 44 and on assembly into base 16; opposing, elongated slits 36 which are adapted to receive the flap 34 on each side and to then retain the side panels 28 and 30 in a generally perpendicular upright position.

The side panels may vary in length and width and typically, are arranged so that they extend slightly above the surface of the article to be packaged to provide additional protection. It is recognized that the side panels 28 and 30 may have additional fold lines, so that the side panels 28 and 30 may extend over the top of the packaged article to provide additional protection, and also that the side panels 28 and 30 may be in W-form, so that the lower level extends below the lower surface or plane of the base 16, so that on insertion in a container 54, the side panels may raise the base of the package slightly above the base of the container 54 to provide additional protection.

The base 16 includes generally perpendicular, opposing end walls 38 and side opposing walls 40 formed together into overlapping inserts in the base sheet material 44. The base 16 including a peripheral, top shelf surface 50 and a bottom shelf surface 52 to which the tension-biased support suspension flaps 26 are hingedly connected through perforation lines 46. While end slots 58 in the sheet material 44 and tabs permit the formation of the sheet material 44 into the base as illustrated 16.

FIG. 7 is directed to a packing system wherein there are two packaged articles 14, and wherein the first and second film layers, 18 and 20, overlap transversely and form a transverse slit, rather than longitudinal overlapping slits, as shown in FIGS. 1–6.

Figure 8:
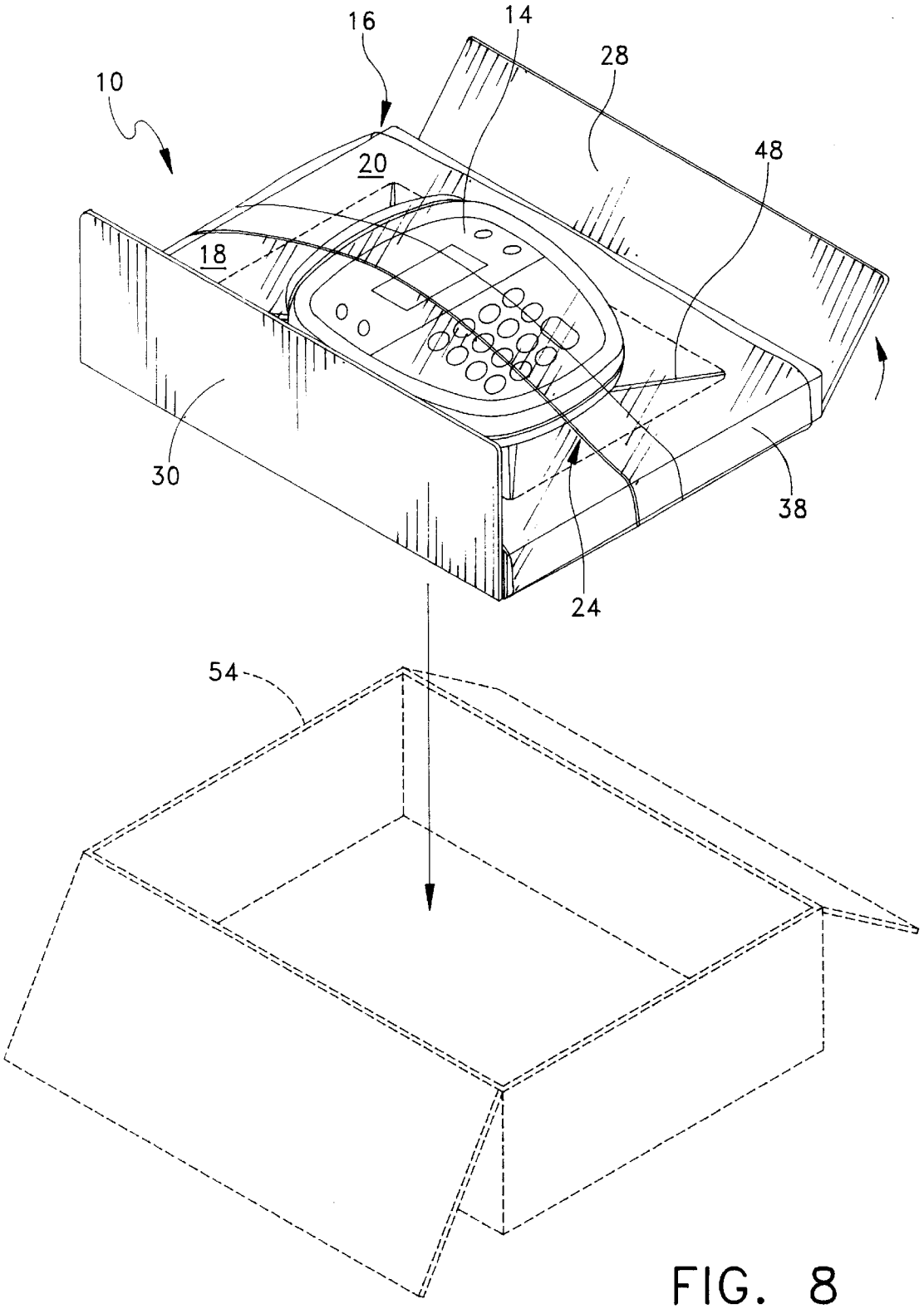
FIG. 8 is a suspended view from above of another support package in a side panel-folded position and inserted within an exterior container shown in dotted lines.

FIG. 8 illustrates the folding of the side panels 28 and 30 into generally perpendicular positions and the insertion of the arcuate cutout flap 34 and slit 36 to retain the side panels 28 and 30 in the upright packaged position.

Figure 9:
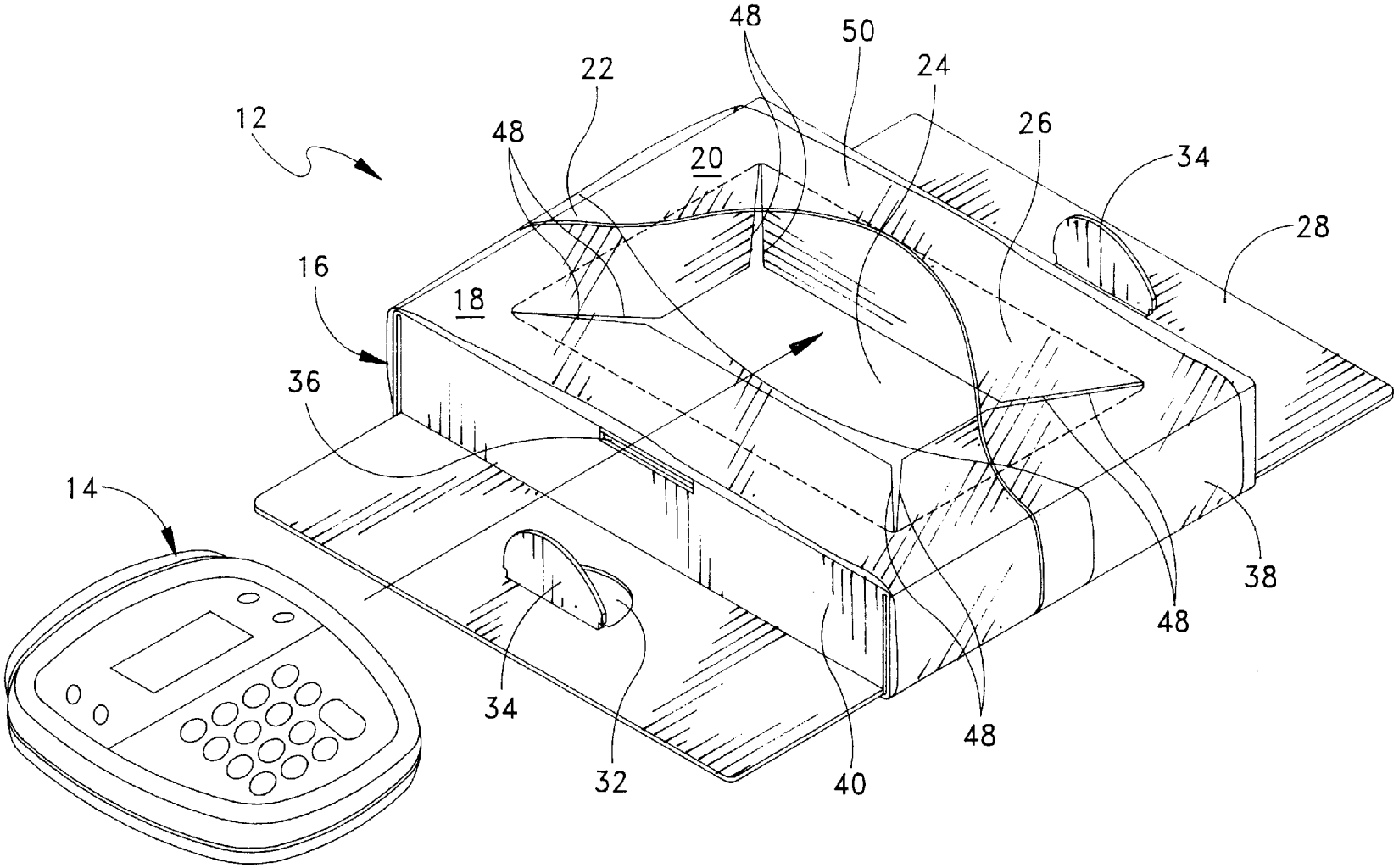
FIG. 9 is a perspective view from above of the package of FIG. 1 with the electronic device shown prior to insertion in the package.

FIG. 9 is an illustration showing that the packaged article 14 outside of the package system 10 and ready to be inserted by the lifting of the film layers 18 and 20 and inserting the article 14 through the slit 24, onto the support flaps 26.

Figure 10:
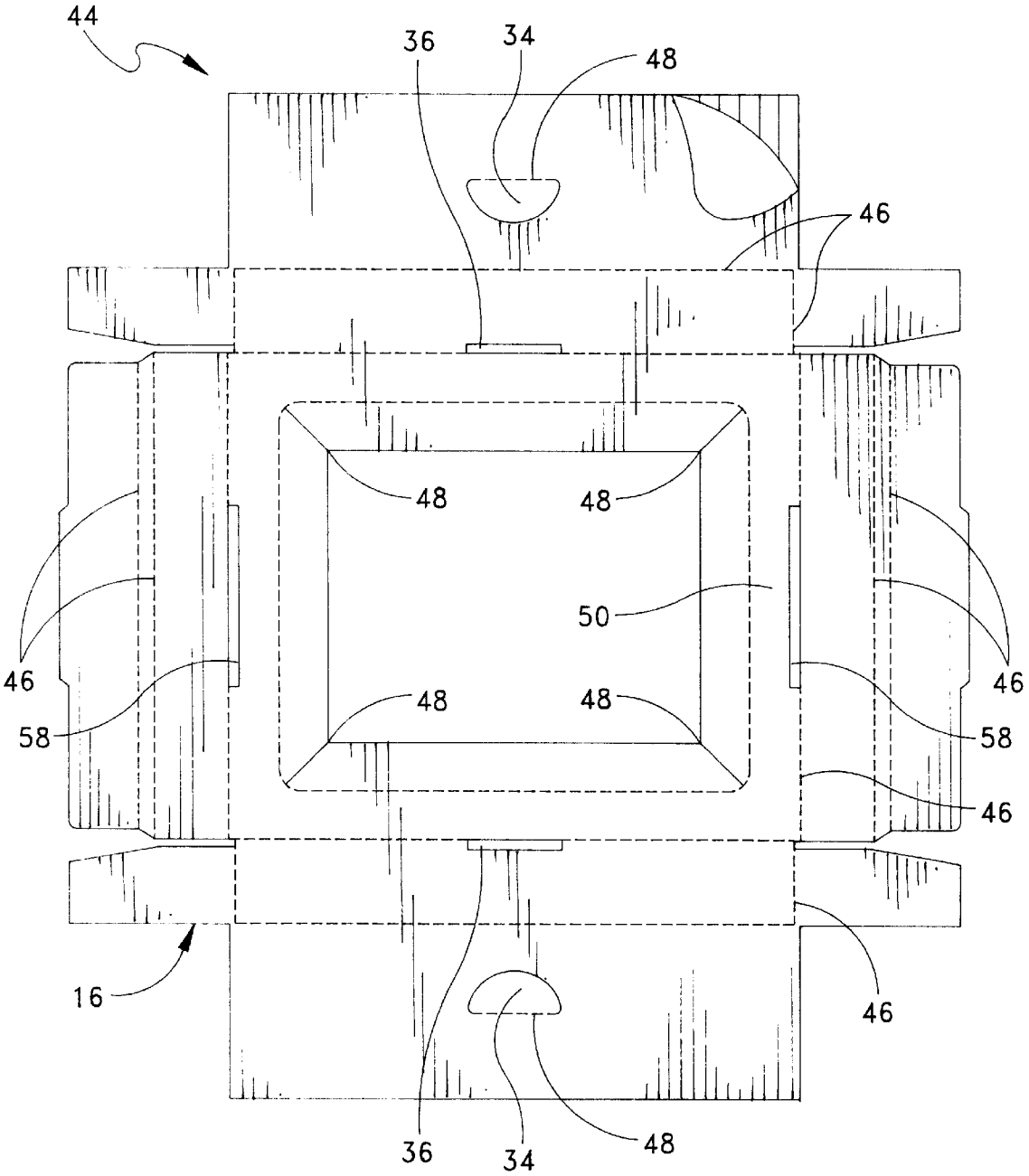
FIG. 10 is a top plan view of the flat sheet material employed to form the base of the package of the invention.
Figure 11:
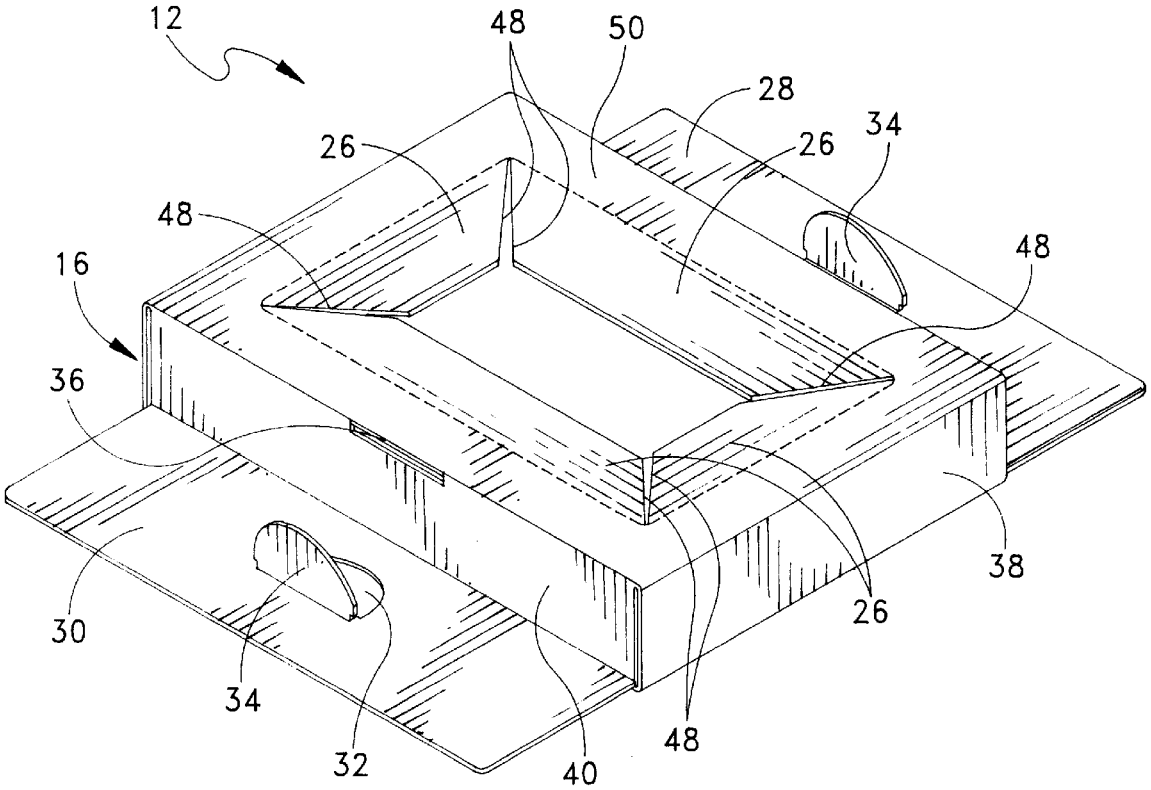
FIG. 11 is a perspective view from above of the base of FIG. 10 in the folded position and without an electronic device or a top-covering thin film material.

FIG. 10 shows the sheet material 44 in a flat, non-folded condition, with perforation 46 (dotted lines) and cutout lines 48, ready to have the sheet material, such as a heavy, stiff cardboard, formed, as desired, into the three dimensional base 16 and for the heat-sealing of thin layers 18 and 20 over the top of the base 16 to complete the package 10.

Figure 12:
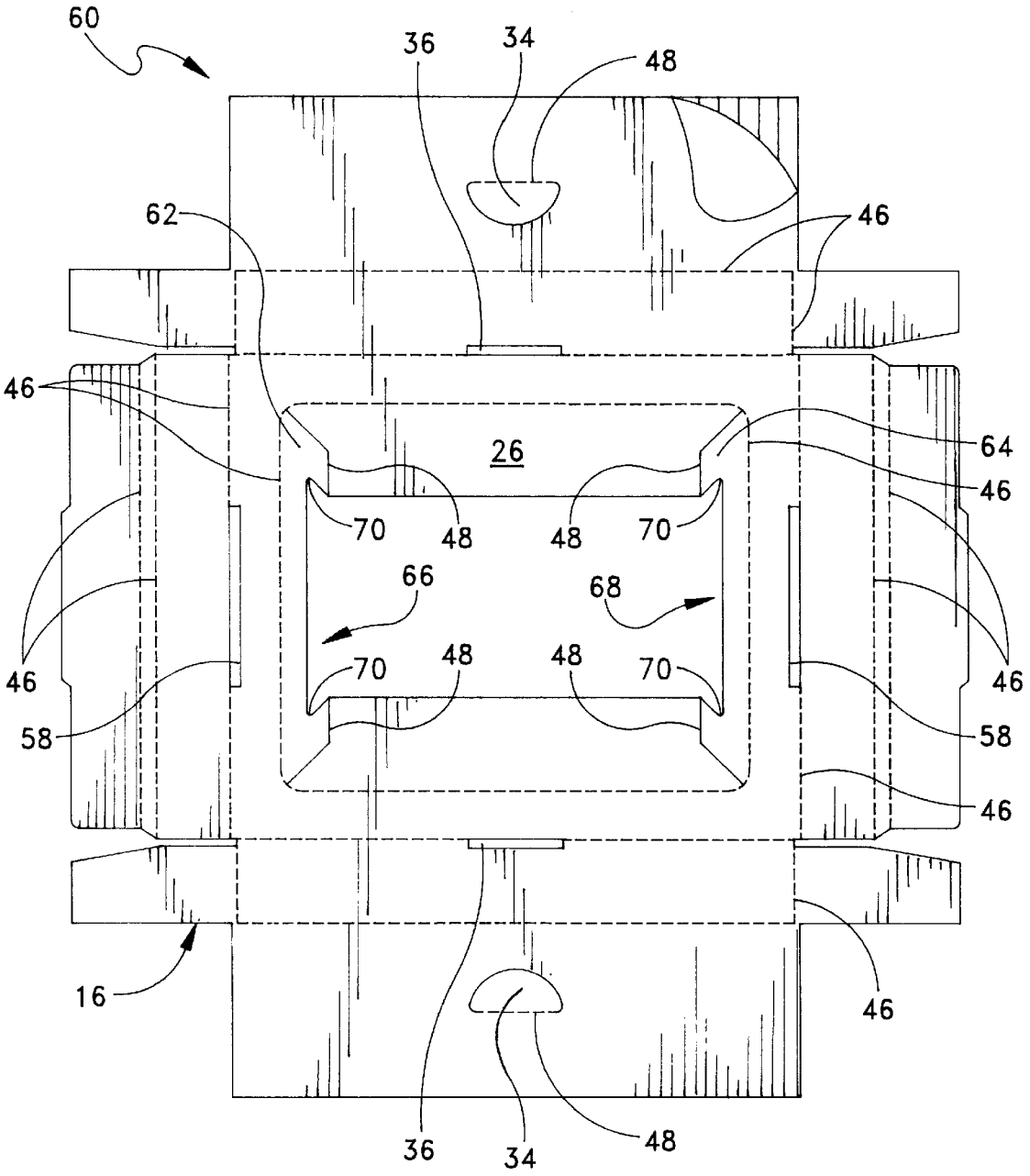
FIG. 12 is a top plan view of a different embodiment of a flat sheet material enlarged to form another base embodiment of the invention.

FIG. 12 shows a flat, non-folded, cardboard sheet material 60 with perforation 46 (dotted lines) and cutout lines 48 like FIG. 10, except that the sheet material includes spaced apart, hinged, opposing, longitudinal end flaps 62 and 64. The end flaps 62 and 64 are not cut at a 45 degree bias as on the prior base in FIG. 10; but rather, are L-shaped cut lines with mock end flaps characterized by dove tail-type, transverse cutout sections 66 and 68 extending substantially across the width of the end flaps 62 and 64 with angled (e.g., 45 degrees) side corners 70, to receive and frictionally hold gathered film tube material 72, as in FIG. 13, on each corner after insertion of the article 14 in the film tube 72 through slit 74.

Figure 13:
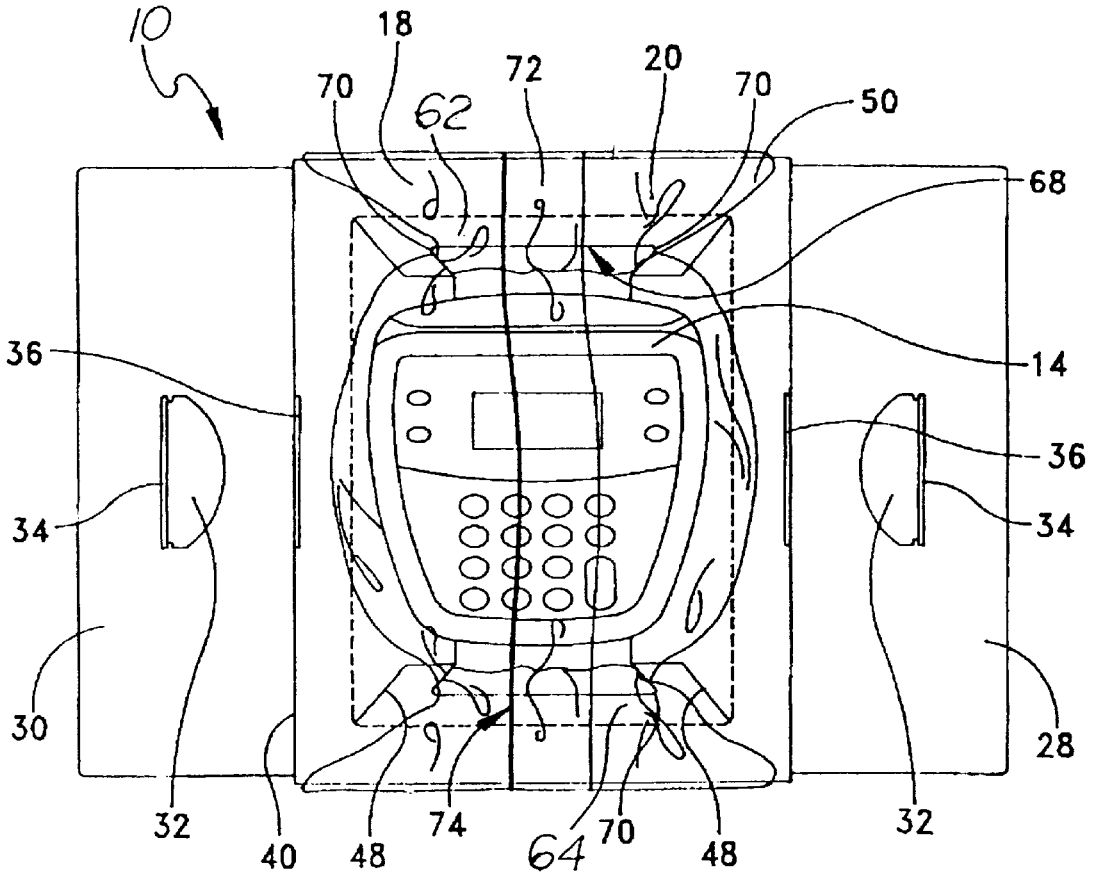
FIG. 13 is a top plan view of a package of the invention employing the base embodiment of FIG. 12.

FIG. 13 shows a package with sheet material 60 folded into a base, with a film tube 72 adhesively secured at each end to the bottom of the constructed base, and having an overlap top slit 74, with an article 14 packaged in the central portion of the base and within the top and bottom layer of the secured film tube 72.

The end flaps 62 and 64 are in an upward position, with the side ends of flaps 62 and 64 raised to a position slightly above the plane of the packaged article 14. The film tube 72 is shown with each side edge adjacent the corner 70 of each section 66 and 68 in a rolled or gathered-together arrangement by the user, frictionally inserted into the corner notches 70 of the dovetail section on each side, at each end, to further hold the article 14 in the desired packaged position, and to further protect the article 14 shown, when or if the package is dropped on its longitudinal axis. As illustrated, the side flaps 26 in this embodiment extend in a slightly angularly, hingedly downward position to support the article within the base.

The package, system and method, as illustrated and described in the embodiments, provide for a simple, effective, low cost protective package for articles to be packaged or inserted into an outward container to permit the insertion and removal about the packaged article and the reuse of the package as desired and permits environmentally sound recycling of the package.

What is claimed is:

1. A package to immobilize and cover an article to be packaged, which package comprises:

a) a base having a top surface and a bottom surface and formed of a stiff sheet material having perforated fold lines and cut lines to form a base with two opposingly spaced, upright side walls and two interconnected opposingly spaced upright end walls;

b) the base includes a plurality of at least one pair of spaced apart, opposing, tension-biased, article-suspension flaps extending from the opposing walls toward an open area in the center of the base; the flaps of sufficient size and tension to receive the article to be packaged and to suspend and immobilize the article within the base;

c) the base includes at least one pair of opposing, extended, side panels adapted to move between an outwardly extended, nonuse position to a generally upright, article-protective use position wherein the side panels extend above the plane of the packaged article in the base;

d) means to secure the side panels in the use position; and e) film material means extending in a snug relationship over the top surface of the base and secured thereto to cover the article to be packaged, the film material means forming an overlapping film area with an open slot to permit the insertion or removal of the article; the film material comprised of a thin, stretchable polymer film material, whereby the article to be packaged is supported and immobilized on the surface of the tension-biased flaps and covered by the film material means.

2. The package of claim 1 which includes the article suspended and immobilized on the tension-biased flaps and protectively covered by the film material means.

3. The package of claim 2 which includes a container, and the package and article within the container with the side panels in the protective use position.

4. The package of claim 1 wherein the stiff sheet material comprises a cardboard sheet material.

5. The package of claim 1 wherein the tension-biased flaps include two pairs of tension-biased flaps, one pair from the end wall and other pair from the side walls.

6. The package of claim 1 wherein the means to secure the side panels comprises a cutout in each side panel and a cutout flap, and the base includes a slit to receive and hold the cutout flaps of the side panel to retain the side panels in the use position.

7. The package of claim 1 wherein the film material means includes an overlap area of about one-half (½) to three (3) inches in width and which extends substantially the length or width of the base.

8. The package of claim 1 wherein the film material means comprises overlapped first and second film layers having ends, the ends of the first and second overlap film layer adhesively secured to the base.

9. The package of claim 1 wherein the film material means comprises the overlap film layers composed of a transparent elastomeric polymer material.

10. The package of claim 1 wherein the base comprises a generally rectangular, three dimensional base with four uniform, upwardly tension-biased flaps about a generally rectangular open central area.

11. The package of claim 1 wherein the tension-biased flaps hingedly extend at an angle on a fold line from a peripheral top shelf surface of the base adjacent opposing side or end walls.

12. The package of claim 1 wherein the film material comprises a film tube having ends adhesively secured to each end respectively of the base and with a top overlapping film area with a longitudinal slit whereby the article is inserted into and removed from the film tube.

13. The package of claim 1 wherein the suspension flaps include a receptor means to provide for sides of gathered film material means to be retained in the receptor means.

14. The package of claim 5 wherein the suspension flaps from the end wall each includes a transverse dovetail open section to receive and hold at each side of said sections gathered sides of the film material means.

15. The package of claim 14 wherein the flaps from the end or side walls are positioned upwardly and the flaps from the opposing end or side walls are positioned downwardly.

16. A method of packaging an article, which method comprises:

a) inserting an article to be packaged between overlapping, slightly stretchable film layers secured over the top surface of a base and over the top surface of upwardly tension-biased, opposing flaps extending toward a central area of the base;

b) suspending and immobilizing the inserted article on the upwardly tension-biased flap surfaces of the base; and c) covering the inserted suspending article with the protective overlapping film layers.

17. A package for an article, which package comprises:

a) a base formed of a cardboard sheet material having opposing and interconnected side and end walls to define an article receiving area therein; the base having opposing extended end and side upwardly tension-biased flaps about an internal space; the flaps adapted to receive and suspend the article to be packaged on the flap surface;

b) first and second overlapping, elastomeric, transparent thin film layers having a one and other end covering the article receiving area and forming selected edge defining film overlap area and a slot there between to permit the insertion or removal of an article into the base, the ends of the film layers adhesively secured to the base; and c) opposing side panels from the base, the side panels adapted to move hingedly between an outward, nonuse position and a nonextended, upright use position adjacent the end or side walls of the base.

* * * * *